US008523337B2

(12) United States Patent
Tsukamura et al.

(10) Patent No.: US 8,523,337 B2
(45) Date of Patent: Sep. 3, 2013

(54) IMAGE FORMING APPARATUS

(71) Applicants: Kiyoshi Tsukamura, Kanagawa (JP); Kenji Hiratani, Kanagawa (JP); Makoto Kikura, Kanagawa (JP); Yuzo Obata, Kanagawa (JP); Daisuke Nakamura, Kanagawa (JP)

(72) Inventors: Kiyoshi Tsukamura, Kanagawa (JP); Kenji Hiratani, Kanagawa (JP); Makoto Kikura, Kanagawa (JP); Yuzo Obata, Kanagawa (JP); Daisuke Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/763,830

(22) Filed: Feb. 11, 2013

(65) Prior Publication Data

US 2013/0155158 A1 Jun. 20, 2013

Related U.S. Application Data

(63) Continuation of application No. 13/058,648, filed on Feb. 11, 2011, now Pat. No. 8,398,218.

(30) Foreign Application Priority Data

Sep. 2, 2008 (JP) ..... 2008-225246
Feb. 27, 2009 (JP) ..... 2009-047125
Mar. 24, 2009 (JP) ..... 2009-072823

(51) Int. Cl.
*B41J 2/175* (2006.01)

(52) U.S. Cl.
USPC ..... 347/85

(58) Field of Classification Search
USPC ..... 347/85
See application file for complete search history.

(56) References Cited

U.S. PATENT DOCUMENTS

| | | | |
|---|---|---|---|
| 5,040,002 | A | 8/1991 | Pollacek et al. |
| 6,022,102 | A | 2/2000 | Ikkatai et al. |
| 6,629,758 | B2 | 10/2003 | Okamoto et al. |
| 7,364,279 | B2 | 4/2008 | Usui et al. |
| 2001/0017641 | A1 | 8/2001 | Kobayashi et al. |
| 2004/0074804 | A1 | 4/2004 | Toba et al. |
| 2004/0169708 | A1 | 9/2004 | Ichihashi et al. |
| 2005/0116997 | A1 * | 6/2005 | Katoh et al. ..... 347/84 |

(Continued)

FOREIGN PATENT DOCUMENTS

| | | | |
|---|---|---|---|
| EP | 1380429 | A2 | 1/2004 |
| EP | 1428664 | A1 | 6/2004 |

(Continued)

OTHER PUBLICATIONS

International Search Report and Written Opinion in PCT/JP2009/064900.

(Continued)

*Primary Examiner* — Matthew Luu
*Assistant Examiner* — Alexander D Shenderov
(74) *Attorney, Agent, or Firm* — Cooper & Dunham LLP

(57) ABSTRACT

An image forming apparatus, includes a liquid jet head; a container main body; an air opening mechanism configured to open and close an air opening path in the container main body. The air opening mechanism includes a holding part, and an opening member movably provided at the holding part. The opening member includes an air communicating path, a filter member, and an air room. An opening cross-sectional area of the air room in a direction perpendicular to an air flow-in direction is greater than an opening cross-sectional area of the air communicating path in a direction perpendicular to an air flow-in direction.

3 Claims, 19 Drawing Sheets

(56) References Cited

U.S. PATENT DOCUMENTS

| | | | |
|---|---|---|---|
| 2006/0028519 | A1 | 2/2006 | Nakamura et al. |
| 2007/0247026 | A1 | 10/2007 | Tsukamura et al. |
| 2008/0136874 | A1 | 6/2008 | Tsukamura |
| 2008/0170108 | A1 | 7/2008 | Lee et al. |

FOREIGN PATENT DOCUMENTS

| | | |
|---|---|---|
| JP | 8-118671 | 5/1996 |
| JP | 3027015 | 1/2000 |
| JP | 3087535 | 7/2000 |
| JP | 2001-212975 | 8/2001 |
| JP | 2003-1846 | 1/2003 |
| JP | 2003-53985 | 2/2003 |
| JP | 2003-89217 | 3/2003 |
| JP | 3450643 | 7/2003 |
| JP | 2003-266690 | 9/2003 |
| JP | 3591355 | 9/2004 |
| JP | 3646431 | 2/2005 |
| JP | 2005-138472 | 6/2005 |
| JP | 2005-254496 | 9/2005 |
| JP | 2007-210231 | 8/2007 |
| JP | 2007-283681 | 11/2007 |
| JP | 2008-143171 | 6/2008 |
| WO | WO2009-051149 | 4/2009 |

OTHER PUBLICATIONS

European Search Report dated Feb. 28, 2013 in corresponding European patent application No. 09 81 1431.7.

* cited by examiner

IMAGE FORMING APPARATUS

CROSS-REFERENCE TO RELATED APPLICATIONS

This application is a Rule 1.53(b) continuation of application Ser. No. 13/058,648, filed on Feb. 11, 2011 as a Section 371 national stage of International Application No. PCT/JP2009/064900 filed Aug. 20, 2009.

TECHNICAL FIELD

The present invention generally relates to liquid containers and image forming apparatuses. More specifically, the present invention relates to an image forming apparatus having a recording head configured to jet liquid drops and a liquid container used in the image forming apparatus.

BACKGROUND ART

As an image forming apparatus such as a printer, facsimile, copier, plotter, or a multifunctional peripheral including the printer, facsimile, copier, and the plotter, an inkjet recording apparatus is known. The inkjet recording apparatus is a liquid jet recording type image forming apparatus using a recording head configured to jet ink liquid drops. In this liquid jet recording type image forming apparatus, the ink liquid drops are jetted from the recording head onto a conveyed sheet so that image forming such as recording or printing is performed.

Hereinafter, the "image forming apparatus" means an apparatus configured to jet liquid onto a medium such as a paper, thread, fiber, leather, hides, metal, plastic, glass, wood, or ceramic so that images are formed. The image forming apparatus includes a mere liquid jetting apparatus. In addition, "image forming" means not only providing an image of characters, figures, or the like on the medium but also providing an image such as a pattern having no meaning on the medium. "Image forming" includes adherence of the liquid drops onto the medium.

Furthermore, "ink" is not limited to the recording liquid or the ink and any liquid that is a fluid when being jetted can be applied to the liquid such as fixing liquid. In addition, the "ink" includes a liquid whereby the image forming can be performed, such as a resist or DNA testing material.

In addition, "sheet" is not limited to a paper but includes an OHP sheet or leather. In other words, the sheet means a subject where the ink drops are adhered. The sheet includes a recorded medium, a recording medium, a recording paper, and a recording sheet.

As such an image forming apparatus (hereinafter "ink jet recording apparatus"), the following apparatuses have been known. In one apparatus, a sub-tank (buffer tank) configured to supply ink to a recording head is mounted on a carriage; a main ink cartridge (main tank) is provided at an apparatus main body; and the ink is supplied and supplemented from the main ink cartridge of the apparatus main body to the sub-tank. In another apparatus, an ink cartridge which is a liquid container exchangeable with a recording head is provided.

As described in Japanese Laid-Open Patent Application Publication No. 2003-1846 and Japanese Laid-Open Patent Application Publication No. 2003-89217, a sub-tank having an air opening valve configured to open an inside to the atmosphere has been suggested. In this suggested example, the air opening valve includes an opening part, a seal part, a spring mechanism, a pressing mechanism part, and a filter. The opening part corresponding to an air opening part is provided on an upper surface of the sub-tank. The seal part is configured to seal the opening part. The spring mechanism part presses the seal part to the opening part. The pressing mechanism part is configured to press the seal part into a sub-tank. The filter is provided outside the opening part. The air opening valve normally blocks an inside of the sub-tank from the atmosphere and is opened by the pressing mechanism part. The example where the filter is provided has been suggested in Japanese Laid-Open Patent Application Publication No. 2003-53985 and Japanese Patent 3087535.

However, in a case where the filter is simply provided at the air side opening of an air communicating path like the above-mentioned related art, foreign particles which cannot be caught by a filter member may enter the air opening path as they are so that of sealability of the valve member may be degraded. As a result of this, sealability of the liquid container may be degraded so that the air enters the container. Hence, it may not be possible to supply the ink stably.

DISCLOSURE OF THE INVENTION

Accordingly, embodiments of the present invention may provide a novel and useful liquid container and image forming apparatus solving one or more of the problems discussed above.

More specifically, the embodiments of the present invention may provide a liquid container whereby the probability of entry of foreign particles which cannot be caught by a filter member into an air opening path as they are is decreased so that degradation of sealability of a valve member is prevented, and an image forming apparatus having the liquid container.

One aspect of the present invention may be to provide an image forming apparatus, including a liquid jet head configured to eject a liquid droplet onto a recording medium; a container main body configured to receive liquid to be supplied to the liquid jet head from an liquid cartridge; an air opening mechanism configured to open and close an air opening path in the container main body, the air opening path being configured to open an inside of the container main body to the atmosphere, wherein the air opening mechanism includes a holding part including a valve body part configured to open and close the air opening path, and an opening member movably provided at the holding part, the opening member being configured to open and close the valve body part by pushed from an outside the container main body; wherein the opening member includes an air communicating path configured to be in communication with the atmosphere and forming a part of the air opening path; a filter member provided at an air side opening part of the air communicating path of the opening member, the filter member having an external surface coming in contact with the atmosphere; and an air room provided at an internal surface side of the filter member; and wherein an opening cross-sectional area of the air room in a direction perpendicular to an air flow-in direction is greater than an opening cross-sectional area of the air communicating path in a direction perpendicular to an air flow-in direction.

Another aspect of the present invention may be to provide an image forming apparatus, including a liquid jet head configured to eject a liquid droplet onto a recording medium; a container main body configured to receive liquid to be supplied to the liquid jet head from an liquid cartridge; and an air opening mechanism configured to open and close an air opening path in the container main body, the air opening path being configured to open an inside of the container main body to the atmosphere, wherein the air opening mechanism includes a holding part including a valve body part configured to open and close the air opening path, an opening member movably provided at the holding part, the opening member being configured to open and close the valve body part by pushed from an outside the container main body, an air communicating path formed between the holding part and the opening member so as to form a part of the air opening path, a filter holding member provided at an air side end part of the opening member, the filter holding member holding a filter member having an external surface coming in contact with the atmosphere, and an elastically deformable sealing member provided between the filter holding member and the holding part, the sealing member being configured to cover an external circumferential side of the opening member; and wherein the filter holding member includes an air room, to which an internal surface side of the filter member faces, and a small communicating path provided between the air room and the air communicating path, an opening cross-sectional area of the small communicating path in a direction perpendicular to an air flow-in direction being smaller than the opening cross-sectional area of the air room in a direction perpendicular to an air flow-in direction.

Another aspect of the present invention may be to provide an image forming apparatus, including a liquid jet head configured to eject a liquid droplet onto a recording medium; a container main body configured to receive liquid to be supplied to the liquid jet head from an liquid cartridge; and an air opening mechanism configured to open and close an air opening path in the container main body, the air opening path being configured to open an inside of the container main body to the atmosphere; wherein the air opening mechanism includes a holding part including a valve body part configured to open and close the air opening path, an opening member movably provided at the holding part, and the opening member being configured to open and close the valve body part by pushed from an outside the container main body, an air communicating path formed between the holding part and the opening member so as to form a part of the air opening path, and a filter member held by the holding part having an external surface coming in contact with the atmosphere; and wherein the holding part includes an air room configured to face an internal surface side of the filter member, and a small communicating path provided between the air room and the air communicating path, and an opening cross-sectional area of the small communication path in a direction perpendicular to an air flow-in direction being smaller than an opening cross-sectional area of the air room in a direction perpendicular to an air flow-in direction.

According to the liquid container of the embodiments of the present invention, an air room is provided between the filter member and the air communicating path or the communicating path which communicates with the air communicating path. The air room has an opening cross-sectional area greater than that of the air communicating path or the communicating path. Accordingly, the foreign particles which cannot be caught by the filter member stay in the air room. Hence, it is possible to prevent the foreign particles from entering the valve member so that bad operations of the valve member can be prevented or the probability of the bad operations can be reduced.

According to the image forming apparatus of the embodiments of the present invention, since the image forming apparatus has the above-mentioned liquid container, it is possible to prevent the sealability of the liquid container from being decreased and prevent the air from unnecessarily entering. Hence, it is possible to perform stable ink supplying without wasting the ink.

Additional objects and advantages of the embodiments will be set forth in part in the description which follows, and in part will become obvious from the description, or may be learned by practice of the invention. The object and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BEST MODE FOR CARRYING OUT THE INVENTION

A description is given below, with reference to the FIG. 1 through FIG. 27 of embodiments of the present invention.

Figure 1:
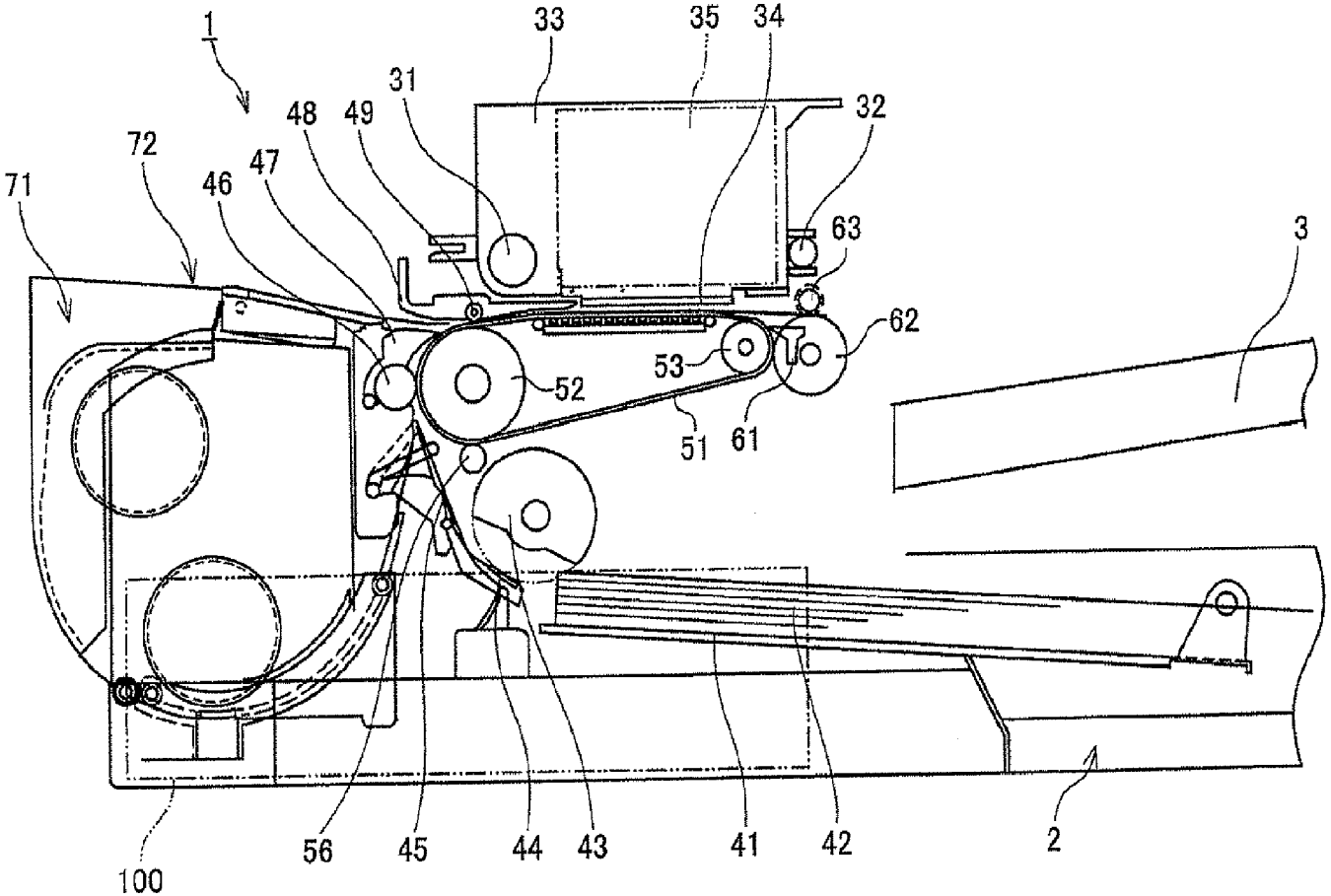
FIG. 1 is a side structural view of an ink jet recording apparatus as an image forming apparatus of embodiments of the present invention having a liquid container (sub-tank) of a first embodiment of the present invention.
Figure 2:
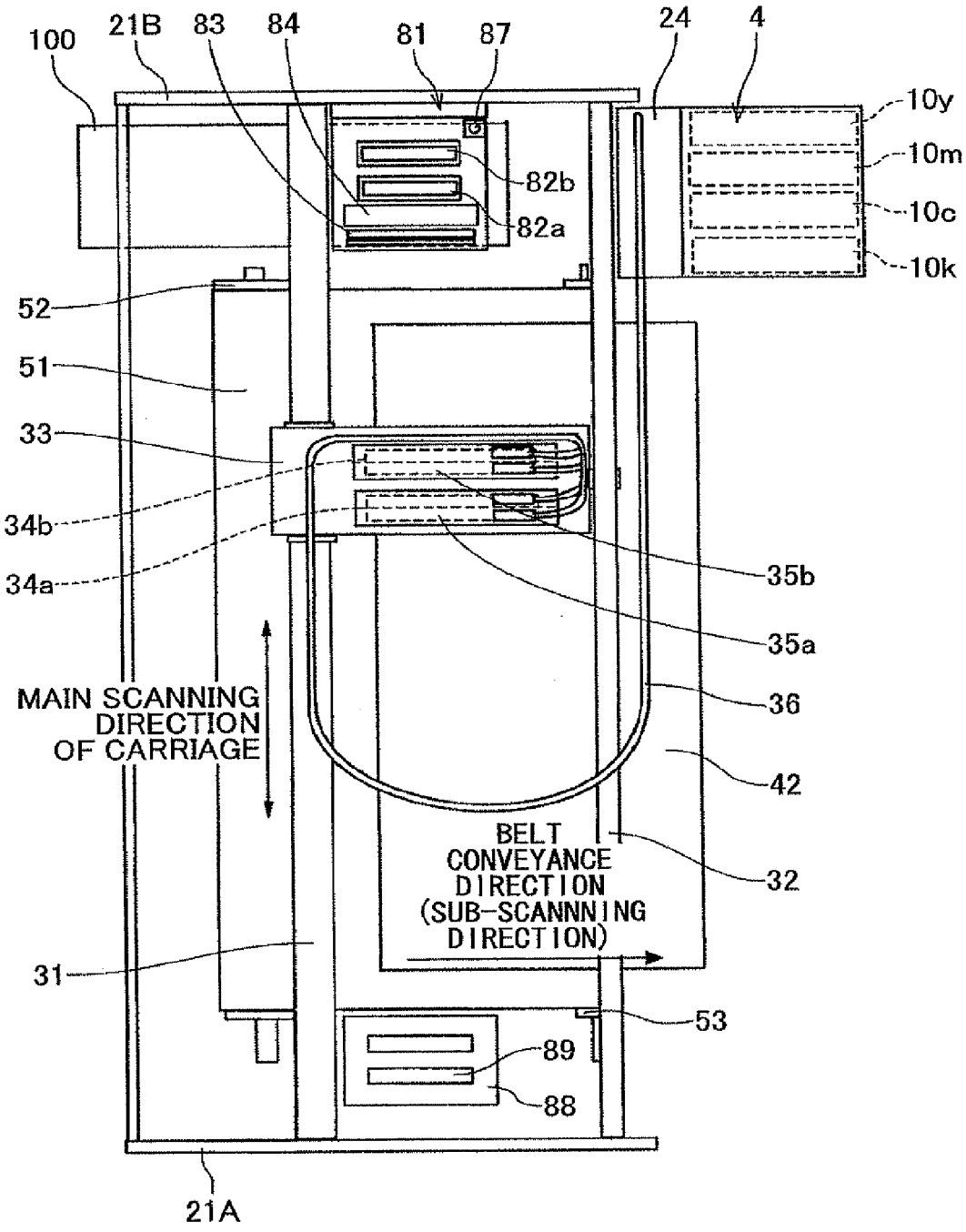
FIG. 2 is a partial plan view of a mechanism part of the ink jet recording apparatus.

First, an example of an image forming apparatus having a liquid container of a first embodiment of the present invention is discussed with reference to FIG. 1 and FIG. 2. Here, FIG. 1 is a schematic drawing showing the side view of an image forming apparatus according to one embodiment. FIG. 2 is a schematic drawing showing the plan view of a main portion of the image forming apparatus according to one embodiment.

The image forming apparatus of this embodiment is a serial type image forming apparatus and includes a main guide rod 31 and a sub-guide rod 32 which are supported at their lateral ends by side boards 21A, 21B. The main guide rod 31 and the sub-guide rod 32 slidably hold a carriage 33. The carriage 33 is moved to scan by a main scanning motor (not shown in FIG. 1 and FIG. 2) via a timing belt in the direction of an arrow (main scanning direction of the carriage) shown in FIG. 2.

The carriage 33 carries a liquid ejecting head including ejecting heads 34*a* and 34*b* which eject ink liquids of yellow (Y), cyan (C), magenta (M), and black (K). Plural nozzles are arranged in rows, and the rows of the nozzles are disposed a sub-scanning direction, which is orthogonal to the main scanning direction of the carriage. The ink liquid ejecting direction is downward.

The ejecting heads 34*a* and 34*b* each include two rows of nozzles. The ejecting head 34*a* ejects black (K) ink liquid from nozzles arranged in one row, and cyan (C) ink liquid from nozzles arranged in a second row. The ejecting head 34*b* ejects magenta (M) ink liquid from nozzles arranged in one row, and yellow (Y) ink liquid from nozzles arranged in a second row.

Sub-tanks 35*a*, 35*b*, which hold in reserve the four color ink liquids corresponding to the ink liquids ejected from the ejecting heads 34*a* and 34*b*, are mounted on the carriage 33. The ink liquids are delivered from ink cartridges 10Y, 10M, 10C, and 10K to the sub-tanks 35*a* and 35*b* by a pump unit 24 via delivering lines 36. The ink cartridges 10Y, 10M, 10C, and 10K are detachably attached to a cartridge mounting portion 4.

The image forming apparatus of the present embodiment includes a crescent-shaped roller (sheet feeding roller) 43 and a dividing pad 44 which is biased toward the roller 43. Sheets 42 are loaded on a sheet loading portion (pressing plate) 41, which is composed of a pressure plate of a sheet feeding tray 2. The roller 43 and the dividing pad 44 are disposed as a sheet feeding portion that feeds the sheets 42 one by one from the sheet loading portion 41.

The image forming apparatus of this embodiment includes a guide portion 45 which guides the sheet 42, a counter roller 46, a guide portion 47, a holding portion 48 which includes a press roller 49, and a feeding belt 51 which holds the sheet 42 by electrostatic attraction and feeds the sheet 42 relative to the position of the ejecting heads 34*a* and 34*b*. The feeding belt 51 is disposed as a feeding portion.

The feeding belt 51 is a looped belt, which is placed in tension about a feeding roller 52 and a tension roller 53, and rotates in a belt conveyance direction (sub-scanning direction), i.e. clockwise direction in FIG. 1. The image forming apparatus of this embodiment includes a charged roller (charging part) 56 which is electrostatically charged and charges the feeding belt 51. The charged roller 56 contacts the surface of the feeding belt 51, and is rotated by the feeding belt 51. The feeding belt 51 is rotated in the sub-scanning direction shown in FIG. 2 by the feeding roller 52, which is rotated by a sub-scanning motor (not shown in FIG. 2).

The image forming apparatus of this embodiment includes, as a sheet discharge part, a separating tooth 61, which separates the sheet 42 from the feeding belt 51, a large sheet discharge roller 62, a small sheet discharge roller 63, and a tray 3 disposed underneath the large sheet discharge roller 62.

The image forming apparatus of this embodiment includes a reversing unit 71 which is detachably attached to a main body 1. The reversing unit 71 receives the sheet 42 which is fed by reverse rotation of the feeding belt 51, and then reverses and feeds the sheet 42 between the feeding belt 51 and the counter roller 46. The reversing unit 71 includes a manual sheet feed tray 72 on its top surface.

Further, the image forming apparatus of the present embodiment includes a maintaining recovering mechanism 81 that maintains the performance of the ejecting heads 34*a* and 34*b* by a restoring process. The maintaining recovering mechanism 81 is disposed in a non-recording area located at one end of the main scanning direction of the carriage 33. The maintaining recovering mechanism 81 includes caps 82A, 82B which cap the nozzle surfaces of the ejecting heads 34*a*, 34*b* respectively, a wiper blade (a wiper member) 83 which wipes the nozzle surfaces, a liquid receiving pan 84 which receives a liquid that does not contribute to the recording and is ejected from the ejecting heads 34*a*, 34*b* in order to remove attached thickened recording liquid, and a carriage lock 87 which locks the carriage 33. A waste liquid tank 100 is disposed under the maintaining recovering mechanism 81 and holds waste liquid generated by maintaining/recovering operations. The waste liquid tank 100 is replaceable relative to the main body 1.

Referring again to FIG. 2, the image forming apparatus of this embodiment includes an idle-ejected liquid receiving pan 88 which is disposed in a non-recording area located at the other end of the main scanning direction of the carriage 33. The liquid receiving pan 88 receives an idle-ejected liquid that does not contribute to the recording and is ejected from the ejecting heads 34*a*, 34*b* in order to remove attached thickened recording liquid. The liquid receiving pan 88 includes an opening 89 provided along the row of the nozzles of the ejecting head 34*a* (or 34*b*).

The image forming apparatus as described above feeds the sheets 42 one by one from the sheet feeding tray 2, and guides the sheet 42 upward along the guide portion 45. The sheet 42 is fed in between the belt 51 and the counter roller 46, guided by the guide portion 47, and is then pressed to the feeding belt 51 by the press roller 49 so as to turn round approximately 90 degrees from the guide portion 45.

The image forming apparatus applies an alternating voltage of plus voltage and minus voltage to the charged roller 56 while the sheet 42 is guided along the feeding belt 51. Thus, the alternating charge distribution of plus charges and minus charges of predetermined length is applied to the feeding belt 51 in the sub-scanning direction, i.e. the rotational direction of the feeding belt 51. When the sheet 42 is fed by the feeding belt 51 with the alternating charge distribution, the sheet 42 is held electrostatically to the feeding belt 51 and fed in the sub-scanning direction by the rotation of the feeding belt 51.

The image forming apparatus causes the carriage 33 to scan, and activates the ejecting heads 34*a* and 34*b* in response to an image signal. Thus, the sheet 42 is recorded one line at a time by the ink liquid ejected from the ejecting heads 34*a* and 34*b*. The image forming apparatus ends recording of the sheet 42 and ejects the sheet 42 to the ejecting tray 3 when the image forming apparatus receives a recording completion signal or a signal indicating that the rear end of the sheet 42 reaches the recording area.

The image forming apparatus moves the carriage 33 to a home position at which the ejecting heads 34*a* and 34*b* oppose the maintaining recovering mechanism 81 when the image forming apparatus maintains and recovers the nozzles of the ejecting heads 34*a*, 34*b*. The image forming apparatus suctions the ink liquid in the ejecting heads 34*a* and 34*b* with the caps 82 capping the nozzle surfaces of the ejecting heads 34*a* and 34*b*, and idle-ejects the liquid which does not contribute to the recording in order to maintain the ejecting heads 34*a* and 34*b*. Thus, the image forming apparatus can provide image forming with stable ejecting.

Figure 3:
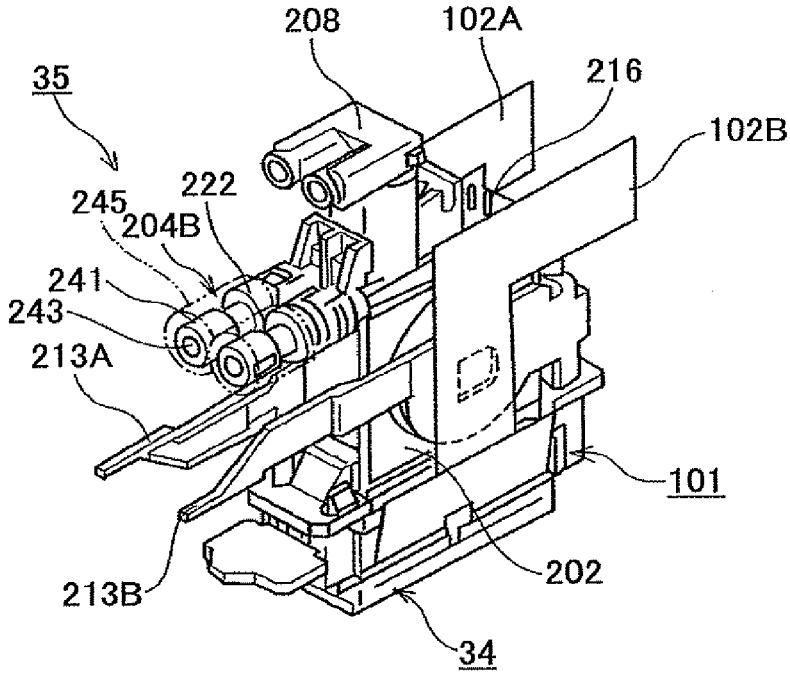
FIG. 3 is a perspective view of a liquid container of the ink jet recording apparatus.
Figure 4:
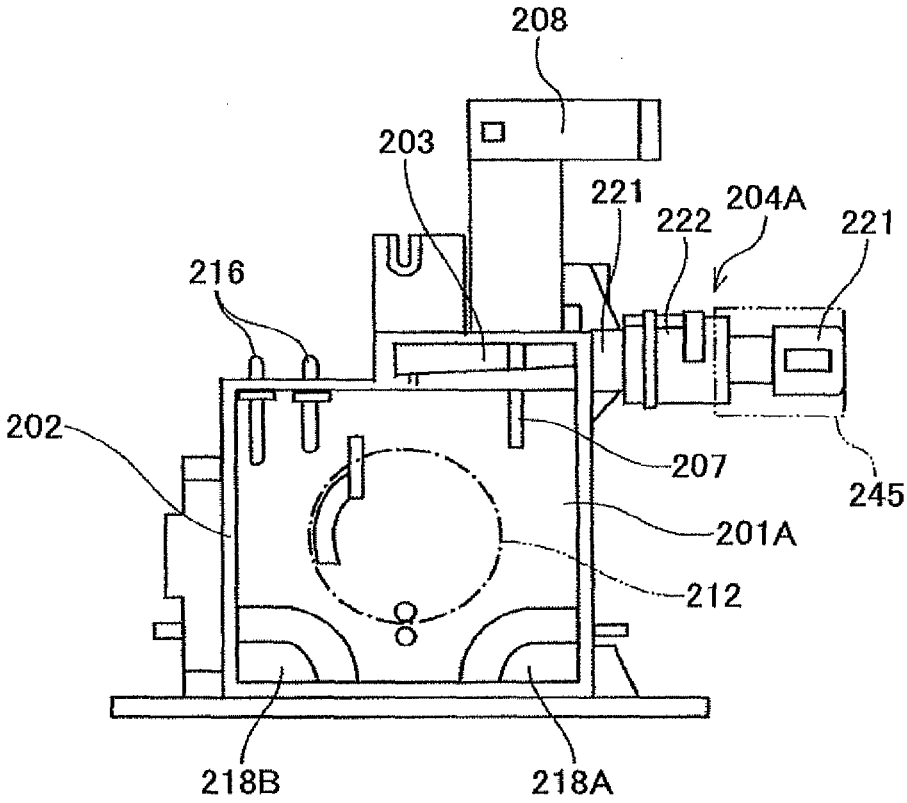
FIG. 4 is a side view of a sub-tank main body (container main body) of the ink jet recording apparatus.
Figure 5:
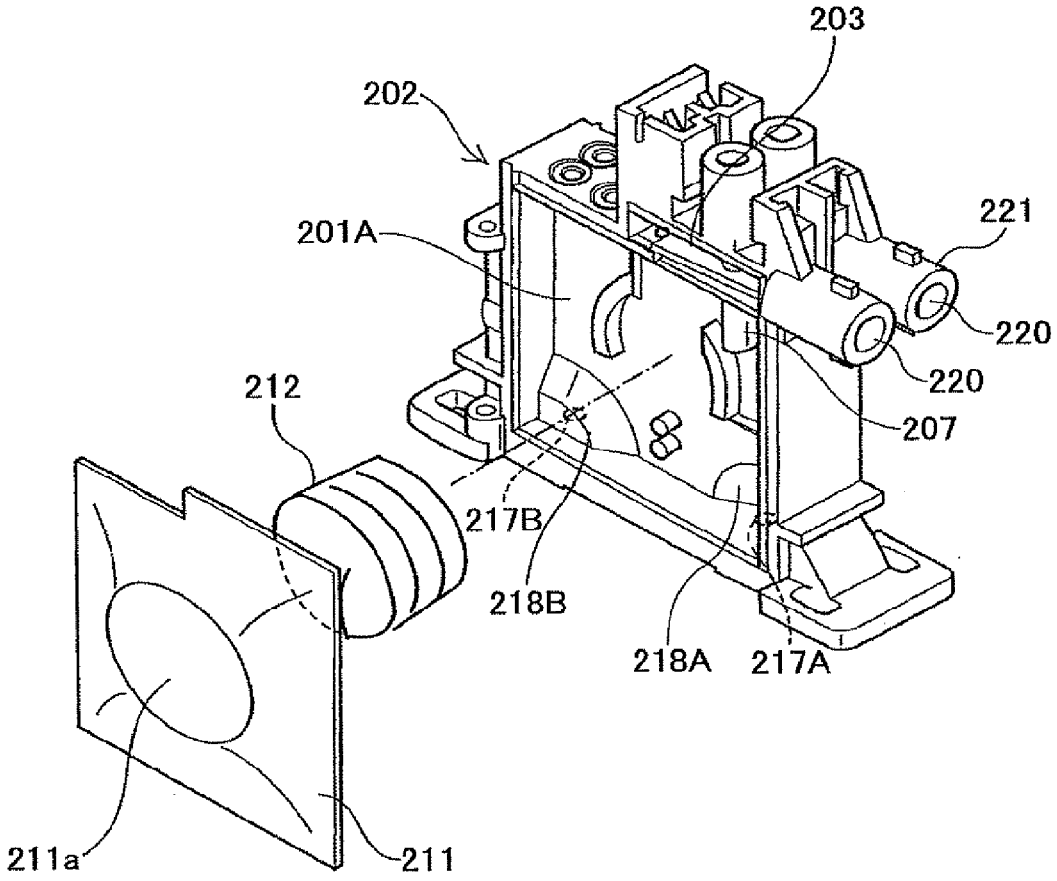
FIG. 5 is an exploded perspective view of the sub-tank main body.

Next, a liquid container (sub-tank) of the first embodiment of the present invention is discussed with reference to FIG. 3 through FIG. 5. Here, FIG. 3 is a perspective view of a head part. FIG. 4 is a side view of the head part. FIG. 5 is an exploded perspective view of the sub-tank main body.

The head part includes a single recording head 34, a sub-tank 35, and a filter unit 101. The sub-tank 35 is configured to supply different color inks to the single recording head 34 and two nozzle rows. The filter unit 101 is provided between the sub-tank 35 and the recording head 34. Flexible cables 102A and 102B are lead out from the recording head 34. The flexible cables 102A and 102B are configured to transfer signals for driving an actuator part of the recording head 34.

In the sub-tank 35, two ink receiving parts 201A, as liquid receiving parts, are formed one at each side of a container main body (tank main body 202). Film members 211 (flexible film members) having flexibility are attached over the openings of the ink receiving parts 201A by adhering or melting the film members 211 so that a sealing state is achieved. In addition, inside the ink receiving part 201A, a spring 212 as an elastic member configured to bias the film member 211 outward is provided between the tank main body 202 and the film member 211. The film member 211 and the spring 212 form a negative pressure generating mechanism. In addition, negative pressure detecting levers 213A/213B are oscillateably provided at the tank main body 202 so as to deform based on deformation of the corresponding film members 211.

Air opening paths 203 are formed at an upper part of the tank main body 202 so as to open the ink receiving parts 201A to the atmosphere. Air opening mechanisms 204A, 204B are provided at the upper part of the tank main body 202 so as to open and close the corresponding air opening paths 203.

Ink supply opening parts 207 are formed in the tank main body 202 so as to supply the inks to the corresponding ink receiving parts 201. The delivering lines 36 are connected to the ink supply opening parts 207 by a connecting member 208. In addition, two detecting electrodes 216 are provided in the upper part of the container main body 202 so as to detect the ink situated in each of the ink receiving parts 201A.

In a bottom surface of the tank main body 202, supply openings 217A, 217B are formed at edge parts of the ink receiving parts 201A so as to individually supply the ink from the ink receiving parts 201A to the filter unit 101. In addition, expanding parts 218A, 218B are provided one in each of the ink receiving parts 201A so as to be expanded into the other receiving part 201A, so that the supply openings 217A, 217B is situated in the center parts.

Next, an air opening mechanism 204 in the sub-tank 35 is discussed with reference to FIG. 6. Here, FIG. 6(*a*) is a plan cross-sectional view of the air opening mechanism part and FIG. 6(*b*) is a partial view showing another example.

The air opening mechanisms 204A and 204B are in communication with the corresponding air opening paths 203 at an upper side part of the tank main body 202. Hollow holder attaching parts 221 forming air opening paths 220 communicating inside and outside of the tank main body 202 with each other are provided in a body with the air opening mechanism 204. Cylindrical shaped holders 222 are attached to the holder attaching parts 221.

Furthermore, a seat member (seat) 223 is sandwiched and held by an outside end surface of the holder attaching part 221 and an inside step part of the holder 222. Balls 224 are received inside the air opening paths 220, as valves pressed and biased in a direction where the seat members are pushed by coil springs 225 as pressing parts. The seat 223, the ball 224, and the coil spring 225 form a valve body part (valve mechanism) configured to open and close the air opening path 220. The holding part which holds this valve body part includes the holder 222 and the holder attaching part 221. FIG. 6 shows where the air opening mechanism 204A opens the corresponding air opening path 220 and the air opening mechanism 204B closes the corresponding air opening path 220.

In the holder 222 forming a holding part which holds the valve body part, an opening member 241 is movably provided. The opening member 241 is configured to open and close the atmosphere opening path 220 by pressing the valve 224 of the valve body part from the outside. At the time of atmosphere opening, the opening member 241 is pressed from the outside (the main body 1 side) by a pressing member 401.

The air communicating path 242 is formed inside the opening member 241. The air communicating path 242 is in communication with the atmosphere and forms a part of the air opening path 220. In addition, as shown in FIG. 6(*a*), horizontal holes 242*a* are provided in the opening member 241 so as to be in communication with the air opening paths 242. The air opening path 220 and the air communicating path 242 inside the opening member 241 are in communication with each other via the horizontal hole 242*a* and an air room 244*b*. In a case where the air communicating path 242 is formed only in an axial direction as shown in FIG. 6(*b*), an air path as a concavoconvex surface may be formed at a part where the opening member 241 and the ball 224 come in contact with each other, so that the air communicating path 242 may not be sealed completely by the ball 224.

A filter member 243 is provided at an air side opening part of the air communicating path 242 of the opening member 241. The filter member 243 has an external surface coming in contact with the atmosphere. An air room 244 is provided at an internal surface side of the filter member 243. The air room 244 has an opening cross-sectional area in a direction perpendicular to an air flow-in direction. The opening cross-sectional area of the air room 244 is greater than an opening cross-sectional area of the air communicating path 242.

As the filter member 243, for example, a metal filter mesh, a compressed sintered filter made of metal fibers, an electroformed metal filter, a foam filter having a porous structure, or the like can be used. In addition, as the filter member 243, a filter having a capillary effect where the air can pass but liquid does not pass in a case of a pressure less than a designated pressure, may be used.

An elastically deformable sealing member 245 is provided between the opening member 241 and the holder 222. The sealing member 245 is configured to cover an external circumferential side of the opening member 241. The sealing member 245 blocks a gap formed between the opening member 241 and the holder 222 from the atmosphere. The sealing member 245 is configured to deform based on a moving action of the opening member 241.

Thus, the air room 244 is provided at the internal surface side of the filter member 243. The air room 244 has the opening cross-sectional area in the direction perpendicular to the air flow-in direction. The opening cross-sectional area of the air room 244 is greater than the opening cross-sectional area of the air communicating path 242. Hence, at the time of the air introduction from the outside, after the air is introduced and diffused in the air room 244, the air is introduced to the air communicating path 242 whose inside is narrow. Therefore, even if a large foreign particle which should be filtered by the filter member 243 passed the filter member 243, the foreign particle may stay in the space (the air room 244). Accordingly, the probability of a foreign particle entering further inside via the air communicating path 242 and the foreign particle being sandwiched at the valve body part (between the seat 223 and the valve 224) so that sealability of the valve body part may be degraded, may be decreased. As a result of this, it is possible to prevent the sealability of the sub-tank being degraded and the air entering the sub-tank unnecessarily so that the ink cannot be supplied stably.

Figure 6:
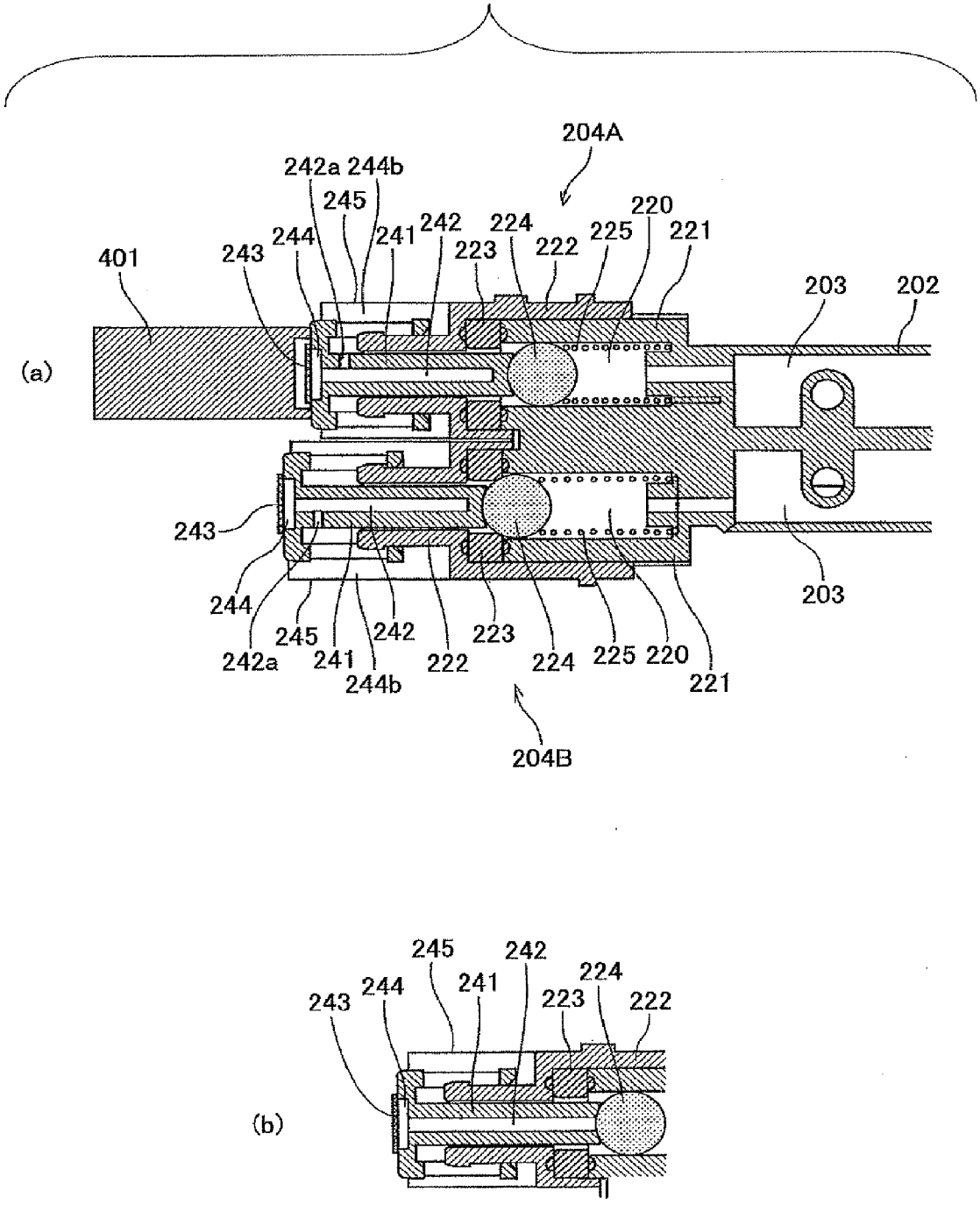
FIG. 6 is a plan cross-sectional view of an air opening mechanism of the liquid container.

In this case, as shown in FIG. 6(*b*), one more air room in front of the valve, namely the air room 244*b* in the sealing member 245 is provided. The volume of the air room 244*b* can be made greater than that of the air room 244. Therefore, even if a large foreign particle which should be filtered by the filter member 243 passes the filter member 243, the probability of the foreign particle entering further inside via the air communicating path 242 and the foreign particle being sandwiched at the valve body part (between the seat 223 and the valve 224) so that sealability of the valve body part may be degraded, may be decreased.

Figure 7:
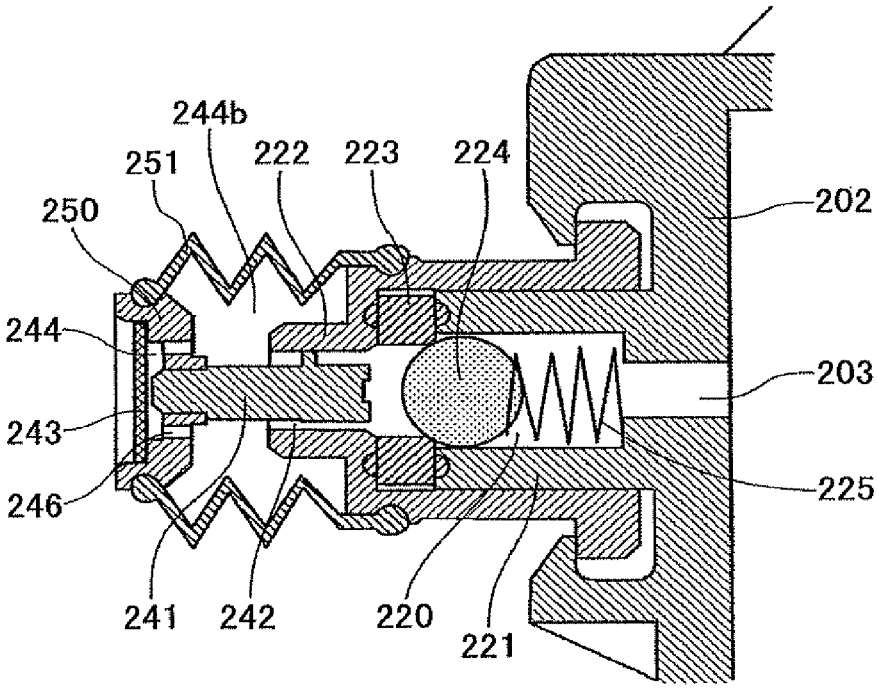
FIG. 7 is an expanded cross-sectional view of an air opening mechanism of a liquid container of a second embodiment of the present invention.
Figure 8:
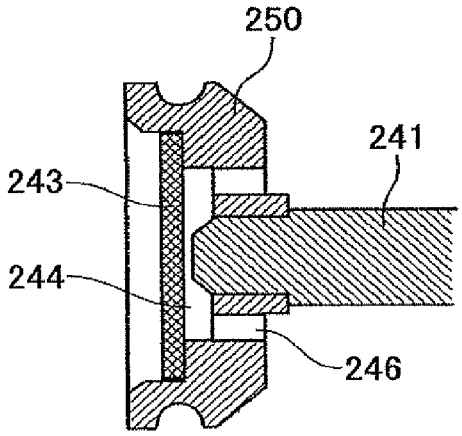
FIG. 8 is a cross-sectional view of a filer holding member of the air opening mechanism.
Figure 9:
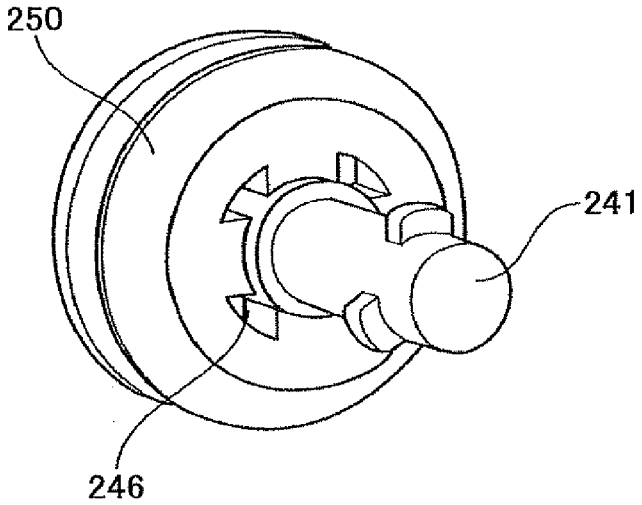
FIG. 9 is a perspective view of the filter holding member.

Next, a liquid container of a second embodiment of the present invention is discussed with reference to FIG. 7 through FIG. 9. FIG. 7 is an expanded cross-sectional view of an air opening mechanism of the liquid container of the second embodiment of the present invention. FIG. 8 is a cross-sectional view of a filer holding member of the air opening mechanism. FIG. 9 is a perspective view of the filer holding member. In FIG. 7 through FIG. 9, parts that are the same as the parts shown in FIG. 1 through FIG. 8 of the first embodiment of the present invention are given the same reference numerals, and their explanation is omitted.

In this example, the opening member 241 is movably provided in the holder 222. The holder 222 is attached to the holder attaching parts 221. A rear end of the holder 222 is engaged with an engaging part of the container main body 202. The opening member 241 is configured to open and close the ball 224 forming a valve body part from the outside. The air communicating path 242 forming a part of the air opening path 220 is formed between the holder 222 and the opening member 241.

A filter holding member 250 is provided at the air side head end part of the opening member 241 by press-fitting. The filter member 243 is held at the filter holding member 250. The filter member 243 has an external surface coming in contact with the atmosphere. The air room 244 and a communicating path 246 are provided in the filter holding member 250. An internal surface side of the filter member 243 faces the air room 244. The communicating path 246 is provided between the air room 244 and the air communicating path 242. The communicating path 246 has an opening cross-sectional area in a direction perpendicular to an air flow-in direction, smaller than that of the air room 244. Although the filter member 243 is fixed by thermal adhesion in this example, the filter member 243 may be adhered by ultrasonic adhesion.

A sealing member 251 having a bellows configuration is provided between the filter holding member 250 and the holder 222 forming the holding member. The sealing member 251 can be elastically deformed. The sealing member 251 is configured to cover the external circumferential side of the opening member 241. The sealing member 251 may be made of, for example, a thin rubber material, an elastomer resin material, or the like. In addition, the filter holding member 250 and the sealing member 251 may be formed in a body. When the filter holding member 250 and the sealing member 251 are formed in a body, for example, a dual molding method by insert or outsert molding can be used. The filter adhesion may be performed before or after unified molding. The sealing member 251 may be formed by the unified molding using the same material as that of the filter holding member 250. In this case, the filter member 243 is made by insert molding.

Thus, in this embodiment as well as the first embodiment, the air room 244 is provided at the internal surface side of the filter member 243. The air room 244 and the air communicating path 242 are in communication with each other by the communicating path 246 having the opening cross-sectional area in the direction perpendicular to the air flow-in direction smaller than that of the air room 244. Hence, at the time of the air introduction from the outside, after the air is introduced and diffused in the air room 244, the air is introduced to the air communicating path 242 whose inside is narrow. Therefore, even if a large foreign particle which should be filtered by the filter member 243 passes the filter member 243, the foreign particle may stay in the space (the air room 244). Accordingly, the probability of a foreign particle entering further inside via the air communicating path 242 and the foreign particle being sandwiched at the valve body part (between the seat 223 and the ball 224) so that sealability of the valve body part may be degraded, may be decreased. As a result of this, it is possible to prevent the sealability of the sub-tank being degraded and the air entering the sub-tank 35 unnecessarily so that the ink cannot be supplied stably.

Furthermore, the air room 244*b* in communication with the air room 244 can be provided inside the sealing member 251. The volume of the air room 244*b* can be made greater than that of the air room 244. Therefore, even if a large foreign particle which should be filtered by the filter member 243 passes the filter member 243, the probability of the foreign particle entering further inside via the air communicating path 242 and the foreign particle being sandwiched at the valve body part (between the seat 223 and the valve 224) so that sealability of the valve body part may be degraded, may be decreased.

According to the structure in this embodiment, it is possible to make configurations of components themselves simple and to easily clean the components before assembling. If the components are not well cleaned, foreign particles may be adhered to the components. The foreign particles may move and be sandwiched by the valve body part so that sealability may be degraded. Hence, by improving the cleanability, it is possible to further improve maintaining the sealability.

Figure 10:
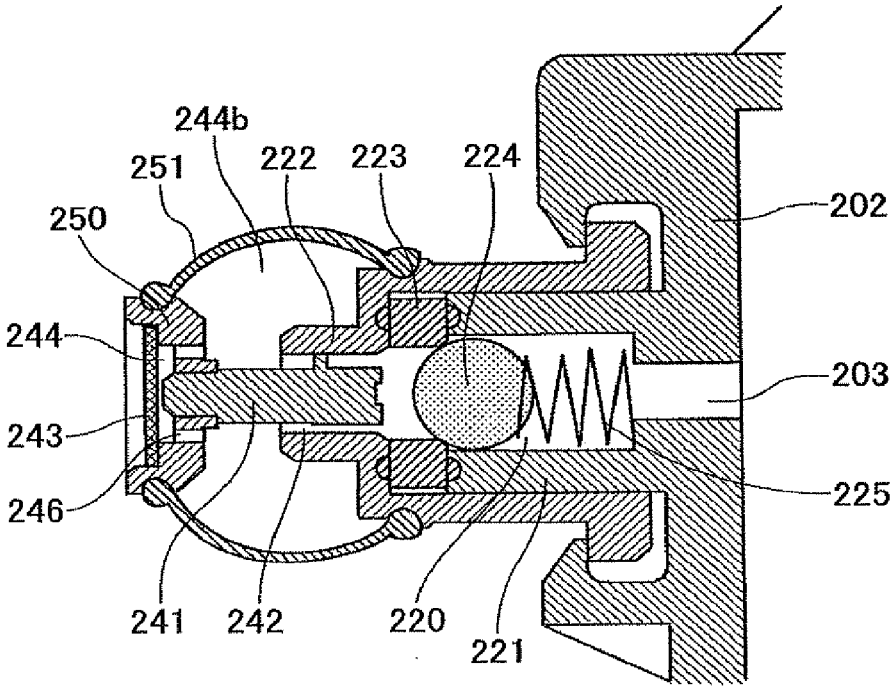
FIG. 10 is an expanded cross-sectional view of an air opening mechanism of a liquid container of a third embodiment of the present invention.

Next, a liquid container of a third embodiment of the present invention is discussed with reference to FIG. 10. FIG. 10 is an expanded cross-sectional view of an air opening mechanism of the liquid container of the third embodiment of the present invention.

Here, an elastically deformable sealing member 251 having a drum-shaped configuration is provided between the filter holding member 250 and the holder 222 forming the holding part so as to cover the external circumferential side of the opening member 241. An inside of the sealing member 251 is used as the air room 244*b* having a large volume and communicating with the air room 244. The action and the effect of this embodiment is the same as the second embodiment.

Figure 11:
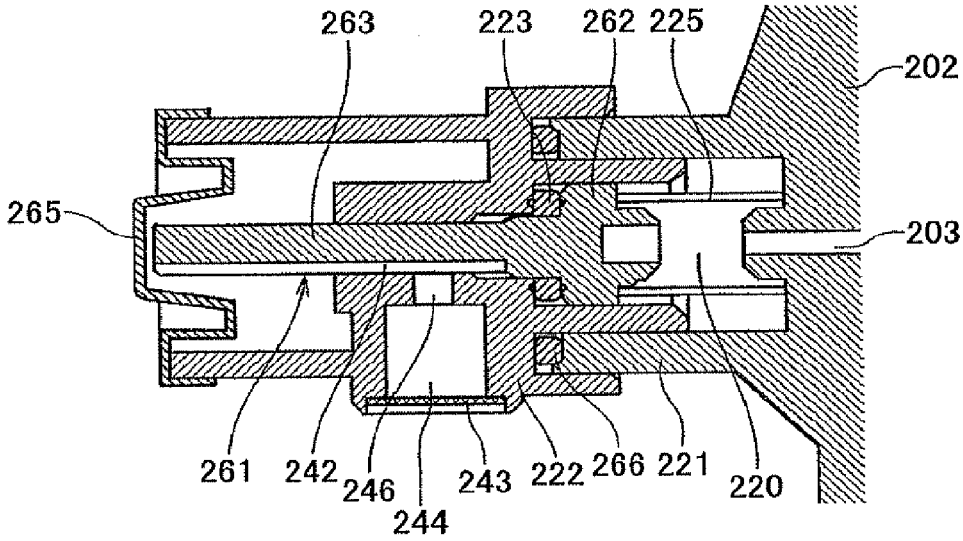
FIG. 11 is an expanded cross-sectional view of an air opening mechanism of a liquid container of a fourth embodiment of the present invention.
Figure 12:
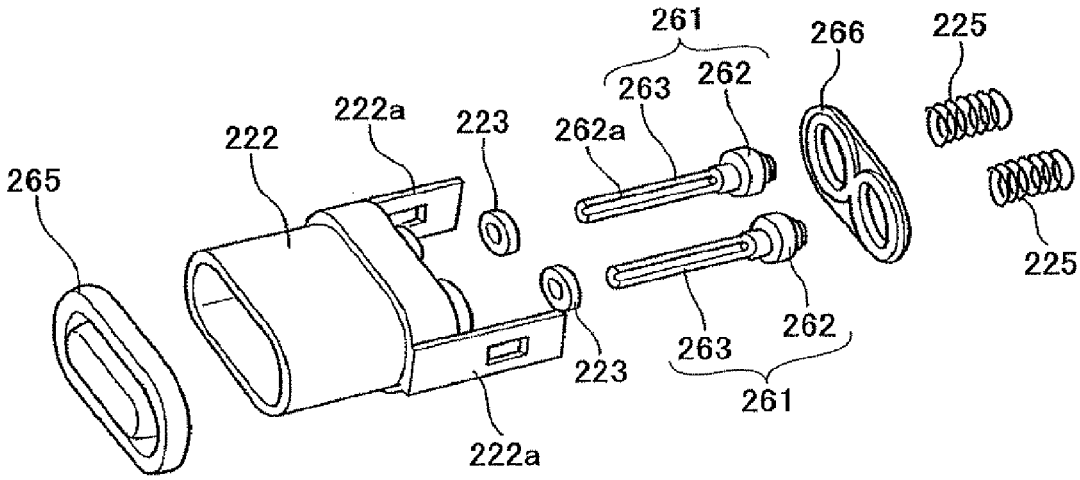
FIG. 12 is a perspective view of the air opening mechanism of the liquid container of the fourth embodiment of the present invention.

Next, a liquid container of a fourth embodiment of the present invention is discussed with reference to FIG. 11 and FIG. 12. FIG. 11 is an expanded cross-sectional view of an air opening mechanism of the liquid container of the fourth embodiment of the present invention. FIG. 12 is an exploded perspective view of the air opening mechanism of the liquid container of the fourth embodiment of the present invention. In FIG. 11 through FIG. 12, parts that are the same as the parts shown in FIG. 1 through FIG. 8 of the first embodiment of the present invention are given the same reference numerals, and their explanation is omitted.

Here, a packing as the seat member 223 is provided inside the holder 222 attached to the holder attaching part 221. The seat member 223 and a valve body part 262 form a valve part. The valve part and an opening member part 263 are formed in a body so that a valve member 261 is formed. The opening member part 263 is configured to open the valve part with the seat member 223 by being pressed from the outside. The valve member 261 is movably provided. The air communicating path 242 forming a part of the air opening path 220 is formed between the holder 222 and a groove 262*a* of the opening member part 263 of the valve member 261.

Here, the valve body part 262 of the valve member 261 is pressed to the seat 223 by a force of the spring 225 so that air blocking is performed.

A filter member 243 having an external surface coming in contact with the atmosphere is held by the holder 222 as the holding part. An air room 244 and a communicating path 246 are provided in the holder 222. An internal surface side of the filter member 243 faces the air room 244. The communicating path 246 is provided between the air room 244 and the air communicating path 242 and has an opening cross-sectional area in a direction perpendicular to an air flow-in direction. The opening cross-sectional area of the communicating path 246 is smaller than an opening cross-sectional area of the air room 244. The communicating path 246 faces the air communicating path 242 in a direction perpendicular to a moving direction of the opening member 263. The air room 244 has an opening part where the filter member 243 is provided. The opening part is provided in a vertical downward direction.

A cap member 265 as an elastically deformable sealing member is provided at the holder 222. The cap member 265 is configured to cover the opening member part 263 of the valve member 261.

As shown in FIG. 12, the holder 222 is a single member configured to receive two valve members 261 corresponding to two air opening mechanisms 204A and 204B. The holder 222 is sealed by the cap member 265 common to each of the air communicating paths 242 (air opening path 220). In addition, a seal member 266 is sandwiched between the holder 222 and the holder attaching part 221. Engaging parts 222*a* engaged with the holder attaching part 221 are provided in the holder 222.

Thus, in this embodiment as well as the first embodiment, the air room 244 is provided at the internal surface side of the filter member 243. The air room 244 and the air communicating path 242 are in communication with each other by the communicating path 246 having the opening cross-sectional area in the direction perpendicular to the air flow-in direction smaller than that of the air room 244. Hence, at the time of the air introduction from the outside, after the air is introduced and diffused in the air room 244, the air is introduced to the air communicating path 242 whose inside is narrow. Therefore, even if a large foreign particle which should be filtered by the filter member 243 passes the filter member 243, the foreign particle may stay in the space (the air room 244). Accordingly, the probability of the foreign particle entering further inside via the air communicating path 242 and the foreign particle being sandwiched at the valve body part (between the seat member 223 and the valve body part 262) so that sealability of the valve body part 262 may be degraded, may be decreased. As a result of this, it is possible to prevent the sealability of the sub-tank being degraded and the air entering the sub-tank 35 unnecessarily so that the ink cannot be supplied stably.

Figure 13:
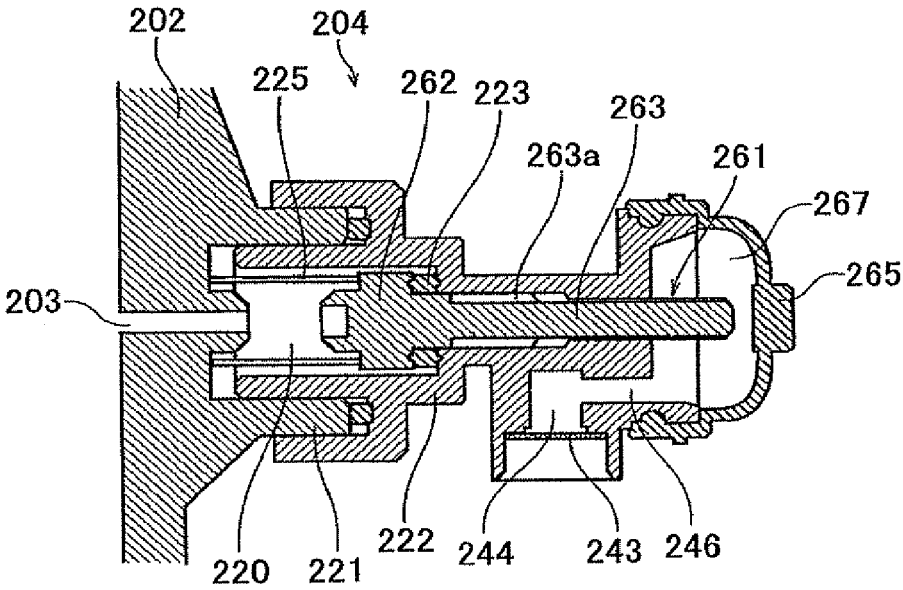
FIG. 13 is an expanded cross-sectional view of the air opening mechanism of the liquid container of the fifth embodiment of the present invention.
Figure 14:
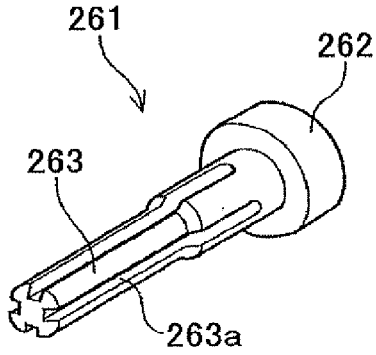
FIG. 14 is a perspective view of a valve member.

Next, a liquid container of a fifth embodiment of the present invention is discussed with reference to FIG. 13 and FIG. 14. FIG. 13 is an expanded cross-sectional view of the air opening mechanism 204 of the liquid container of the fifth embodiment of the present invention. FIG. 14 is a perspective view of a valve member 261.

In this embodiment as well as the fourth embodiment, a packing as the seat member 223 is provided inside the holder 222 attached to the holder attaching part 221. The seat member 223 and a valve body part 262 form a valve part. The valve part and an opening member part 263 are formed in a body so that the valve member 261 is formed. The opening member part 263 is configured to open the valve part with the seat member 223 by being pressed from the outside. The valve member 261 is movably provided. The air communicating path 242 forming a part of the air opening path 220 is formed between the holder 222 and a groove 263*a* of the opening member part 263 of the valve member 261.

Here, the valve body part 262 of the valve member 261 is pressed to the seat member 223 by a force of the coil spring 225 so that air blocking is performed.

A filter member 243 having an external surface coming in contact with the atmosphere is held by the holder 222 as the holding part. An air room 244 and a communicating path 246 are provided at the holder 222. An internal surface side of the filter member 243 faces the air room 244. The communicating path 246 is provided between the air room 244 and the air communicating path 242 and has an opening cross-sectional area in a direction perpendicular to an air flow-in direction. The opening cross-sectional area of the communicating path 246 is smaller than an opening cross-sectional area of the air room 244.

A cap member 265 as an elastically deformable sealing member is provided at the holder 222. The cap member 265 is configured to cover the opening member part 263 of the valve member 261.

In this embodiment, the communicating path 246 is provided in a direction along a moving direction of the opening member part 263 (valve member 261) relative to the air communicating path 242. The communicating path 246 is in communication with the air communicating path 242 via the space (air opening) 267 formed between the holder 222 and the cap member 265 as the sealing member. The air room 244 has an opening part where the filter member 243 is provided. The opening part is provided in a vertical downward direction.

Thus, by providing the communicating path 246 which connects the air communicating path 242 and the air room 244 to each other in the direction along the moving direction of the opening member 263, it is possible to securely prevent dust from entering from the air room 244 to the air communicating path 242.

In the fourth embodiment and the fifth embodiment, by the air communicating path 242 and the air room 244, connected to the atmosphere, being in communication with each other via the communicating path 246, even if the ink leaks into the air opening mechanism 204, it is possible to reduce the flow-out of the ink to the outside. In addition, since the opening part where the filter member 243 is provided is provided in a vertical downward direction in the air room 244 communicating with the outside via the filter member 243, it is possible to drop the ink downward in the vertical direction even if the ink enters inside the air room 244. Hence, it is possible to prevent the leaking ink from easily entering other parts.

Supply operations of moving the ink to the sub-tank 35 are performed while the ink liquid surface height is detected by the detecting electrodes 216. However, there may be a case where the ink liquid surface height cannot be detected by the detecting electrodes 216, namely a case where the ink which is being used does not have an expected resistance value. In this case, if excessive ink is supplied to the sub-tank 35, the ink may enter the air opening mechanism 204 from the inside of the sub-tank 35.

Figure 15:
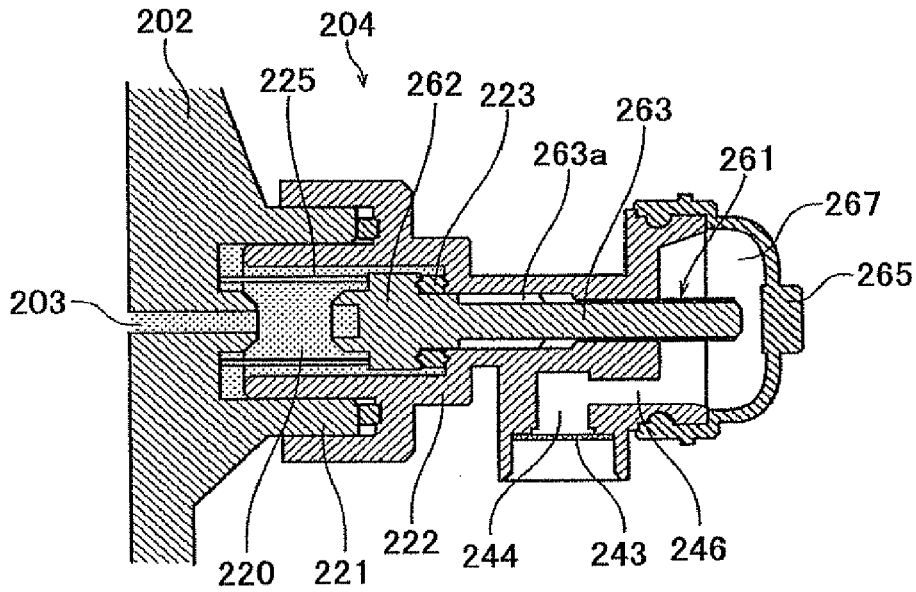
FIG. 15 is a cross-sectional view for explaining the entry of ink into the air opening mechanism of the sub-tank.
Figure 16:
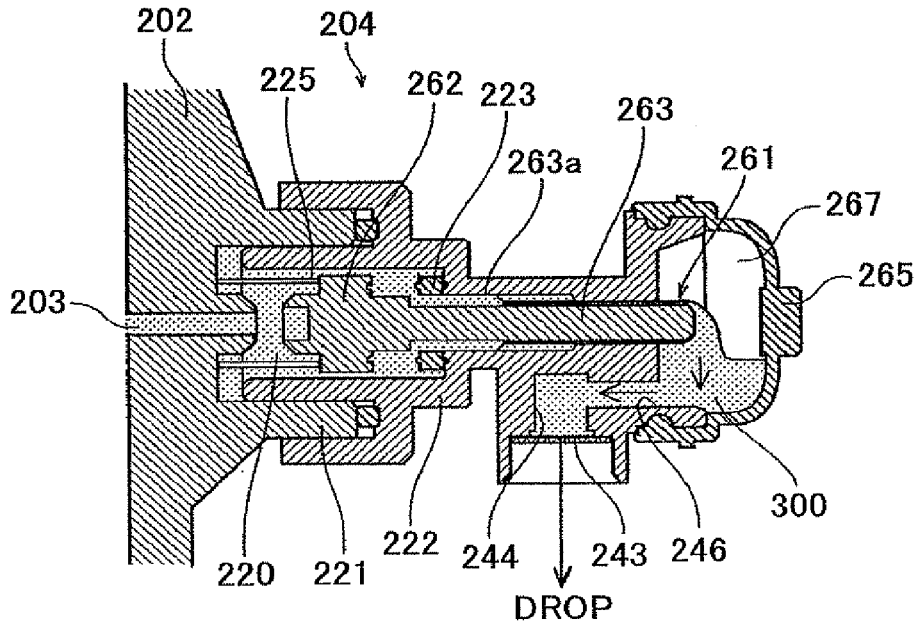
FIG. 16 is a cross-sectional view for explaining leakage of the ink from the air opening mechanism of the sub-tank.

Here, as shown in FIG. 15, when then valve member 261 of the air opening mechanism 204 is closed, the entered ink stays at the internal side held by the seat member 223 and does not further flow. However, in this state when the valve member 261 is pushed, as shown in FIG. 16, for supplying the ink to the sub-tank 35, the seat member 223 and the valve body part 262 are separated so that, as indicated by an arrow in FIG. 16, ink 300 flows into the a space 267 via the groove 263*a* of the valve member 261. In addition, the ink flows from the space 267 to the air room 244 via the communicating path 246 so as to drop downward in the vertical direction via the filter member 243.

Because of this, the ink 300 leaking from the air opening mechanism 204 of the sub-tank 35 is not scattered and can be gathered in a narrow area. It is possible to easily specify a portion where the ink further leaking is stored. Hence, it is possible to easily prevent the leaking ink from entering the board side of the driver IC provided at the flexible cables (FPC) 102A, 102B.

Figure 17:
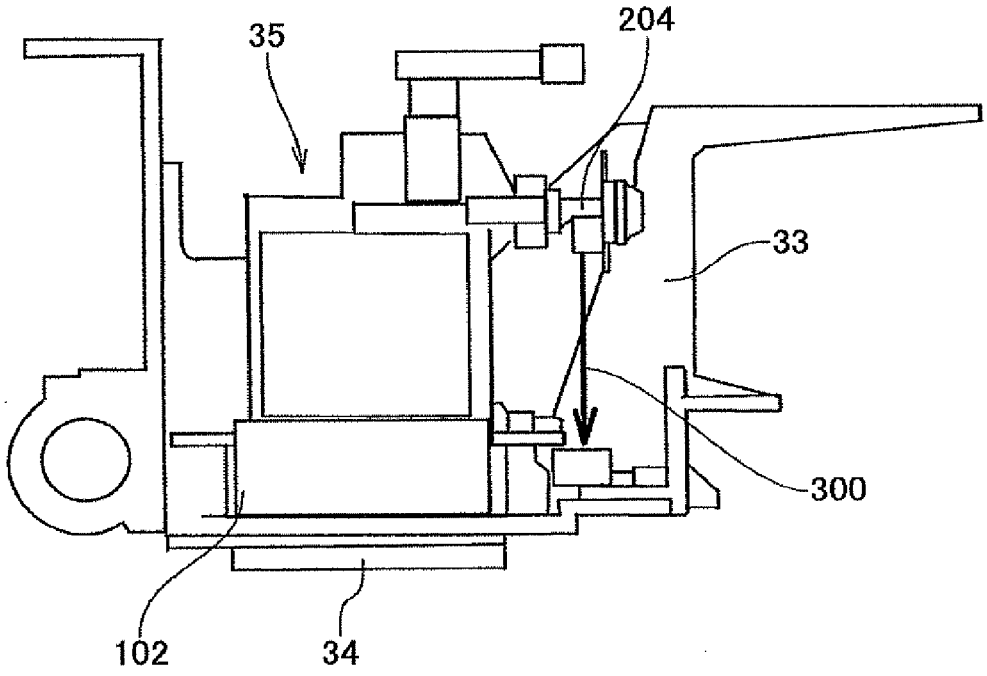
FIG. 17 is a side view for explaining a structure for preventing flow of the ink leaking from the air opening mechanism of the sub-tank.
Figure 18:
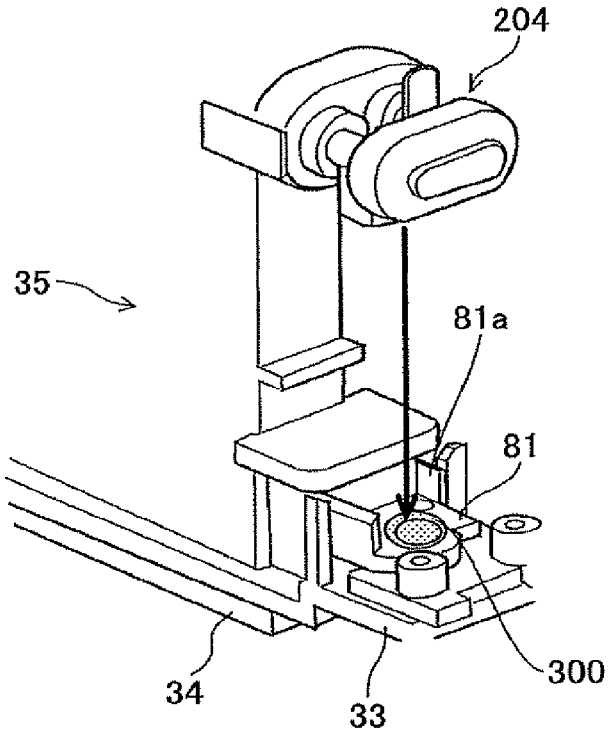
FIG. 18 is an expanded perspective view of the periphery of a part where the recording head is attached to the carriage.
Figure 19:
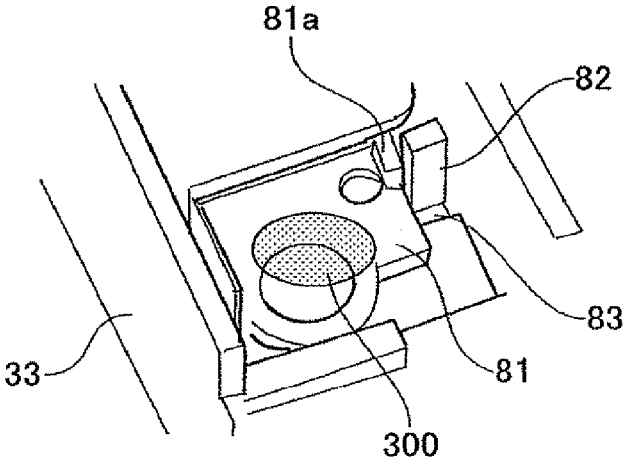
FIG. 19 is a partially expanded perspective view of FIG. 18.

Next, a structure for preventing the ink leaking from the air opening mechanism 204 of the sub-tank 35 is discussed with reference to FIG. 17 through FIG. 19. FIG. 17 is a side view where the recording head 34 in a body with the sub-tank 35 is mounted on the carriage 33. FIG. 18 is an expanded perspective view of the periphery of a part where the recording (ejecting) head 34 is mounted on the carriage 33. FIG. 19 is a partially expanded perspective view of FIG. 18.

An adjusting member 81 for attaching the recording head 34 to the carriage 33 is provided at the recording head 34. The adjusting member 81 and the carriage 33 are connected to each other by, for example, a UV adhesive so that recording head 34 is attached to the carriage 33.

Here, the ink 300 dropping from the air opening mechanism 204 of the sub-tank 35 drops on the adjusting member 81. In order to prevent the dropped ink 300 from entering inside the carriage 33, a rib 82 having a block configuration is provided inside the carriage 33. With this structure, the dropped ink 300 does not enter the FPC 102A, 102B of the recording head 34. In addition, a piercing hole 83 is provided in the vicinity of a portion where the ink in the carriage 33 drops. The leaking ink 300 flows out from the piercing hole 83 to the outside.

A rib 81*a* is provided at the adjusting member 81 in order to prevent the leaked ink 300 from entering the recording head 34 side.

By providing a part configured to detect the ink at the portion where the leaked ink 300 drops, it is possible to detect that the ink liquid surface detection of the sub-tank 35 does not effectively function and detect an abnormality of the sub-tank 35. In other words, by the ink flowing out and entering the air opening mechanism 204 of the sub-tank 35, it is possible to give notice to the user of the abnormality that ink is overflowing and the necessity of repairing.

Figure 20:
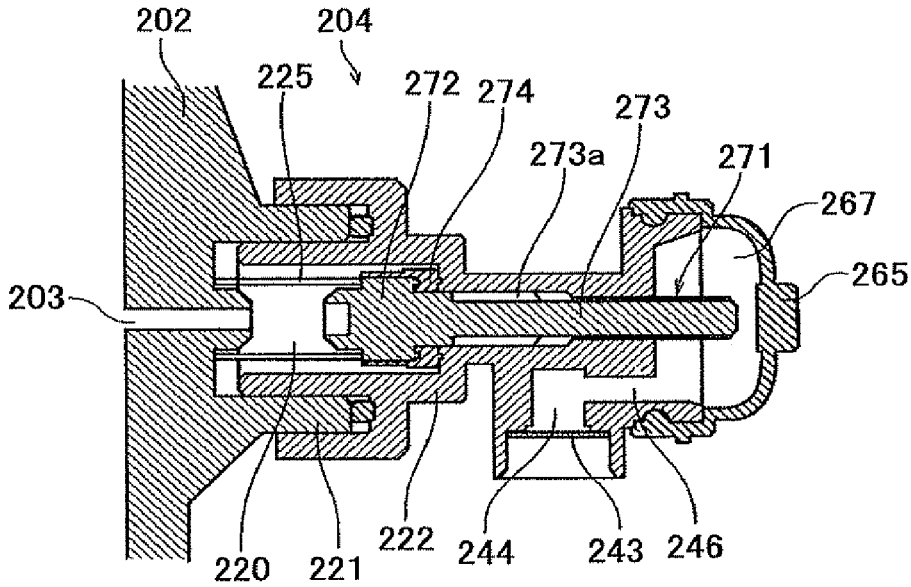
FIG. 20 is an expanded cross-sectional view of an air opening mechanism of a liquid container of a sixth embodiment of the present invention.
Figure 21:
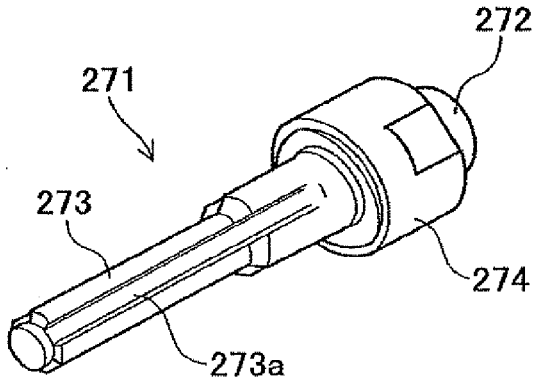
FIG. 21 is a perspective view of a valve member of the sixth embodiment of the present invention.
Figure 22:
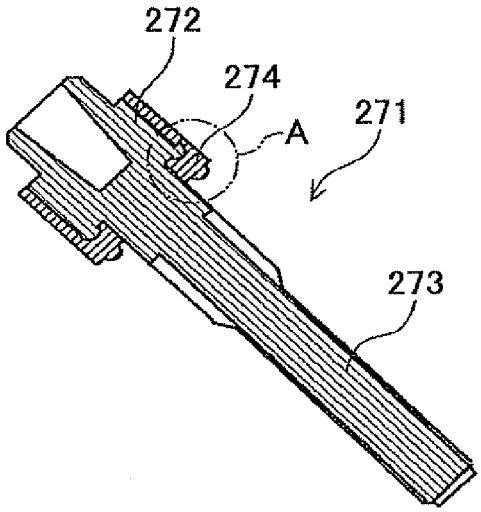
FIG. 22 is a cross-sectional view of a valve member of the sixth embodiment of the present invention.
Figure 23:
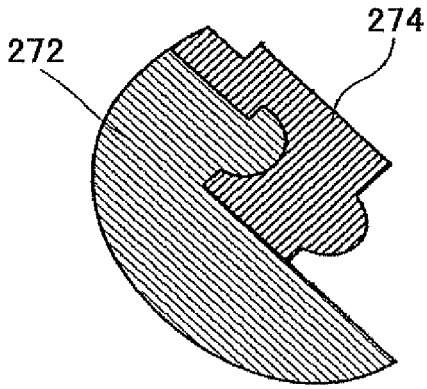
FIG. 23 is a partial expanded view of a part A shown in FIG. 22.

Next, a sixth embodiment of the present invention is discussed with reference to FIG. 20 through FIG. 23. FIG. 20 is an expanded cross-sectional view of an air opening mechanism 204 of a liquid container of the sixth embodiment of the present invention. FIG. 21 is a perspective view of a valve member of the sixth embodiment of the present invention. FIG. 22 is a cross-sectional view of a valve member of the sixth embodiment of the present invention. FIG. 23 is a partial expanded view of a part A shown in FIG. 22.

In this embodiment, a valve member 271 is used instead of the valve member 261 of the fifth embodiment. The valve member 271, as shown in FIG. 21 through FIG. 23, is formed by double molding a valve pin 273 including a seat holding part 272 and a groove 273*a* in an external circumferential surface axial direction corresponding to the opening member and a seat 274 made of elastomer.

In this case, by moving of the valve member 271, a gap is formed between the seat 274 and the step part of the holder 222 so that the air opening path 220 is opened. When the seat 274 comes in contact with the step part of the holder 222, the air opening path 220 is blocked.

With this structure, it is possible to reduce the number of the components.

Figure 24:
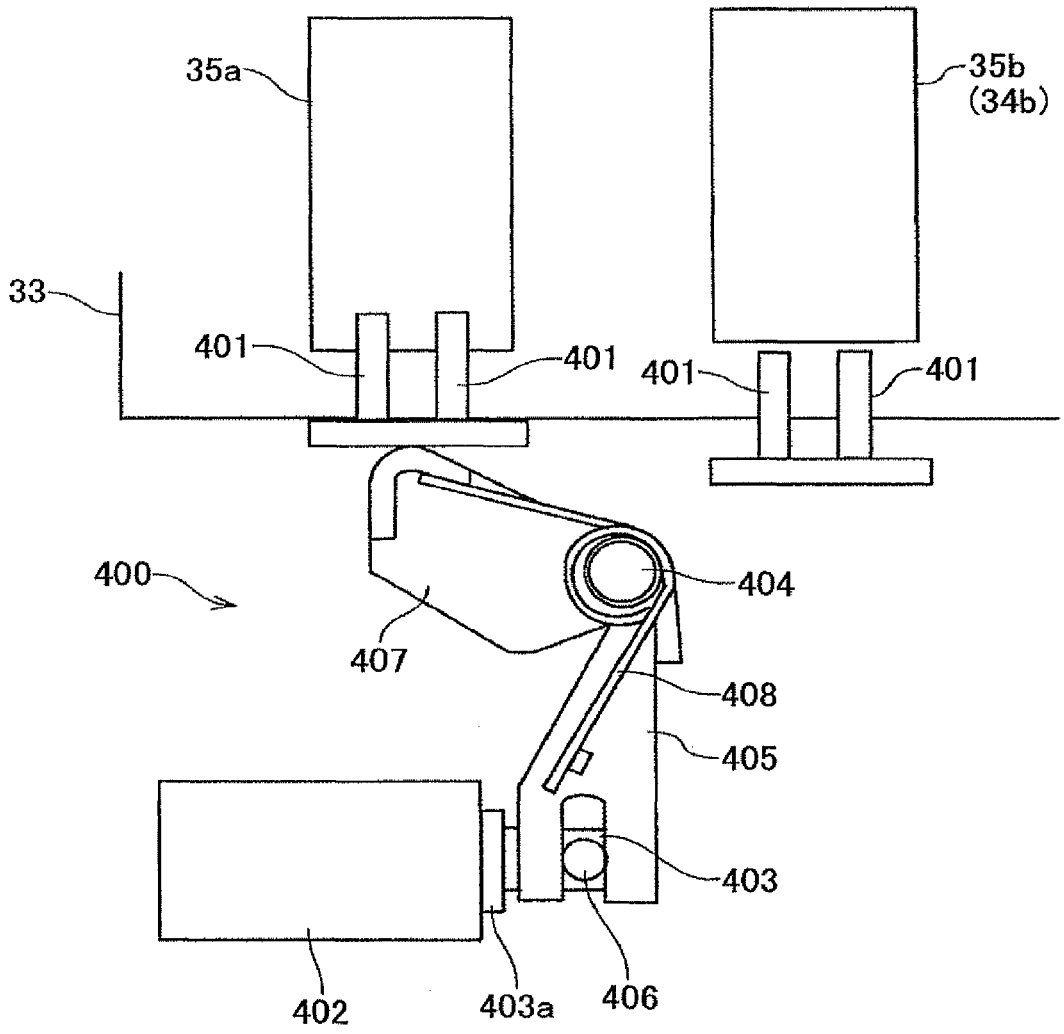
FIG. 24 is a schematic view for explaining an air opening mechanism driving mechanism configured to drive the air opening mechanism.

Next, an air opening mechanism driving mechanism 400 configured to move the opening member of the air opening mechanism 204 is discussed with reference to FIG. 24. FIG. 24 is a schematic view for explaining the air opening mechanism driving mechanism 400 configured to drive the air opening mechanism 204. It should be noted that, although the structure of the air opening mechanism 204 is discussed in the sixth embodiment, there is no limitation of the structure of the air opening mechanism 204.

In the air opening driving mechanism 400, a pressing member 401 is movably held at the carriage 33. The pressing member 401 is configured to press the opening member part 263 of the valve member 261 of the air opening mechanism 204. Here, two pressing members 401 are provided in a body corresponding to two air opening mechanisms 204A, 204B of a single sub-tank 35. The pressing member 401 is held in a non-pressing position by a spring member (not shown).

On the other hand, a solenoid 402 is provided at an apparatus main body side. An end part of a first lever 405 is oscillateably engaged with a plunger 403 of the solenoid 402 by a pin member 406. Another end part of the first lever 405 is pivotally supported at a spindle 404. In addition, an end part of a second lever 407 is oscillateably and pivotally supported at the spindle 404. Another end part of the second lever 407 can come in contact with the pressing member 401. A spring member 408 is provided between the first lever 405 and the second lever 407. The spring member 408 is configured to hold the first lever 405 and the second lever 407 with a designated positional relationship.

Figure 25:
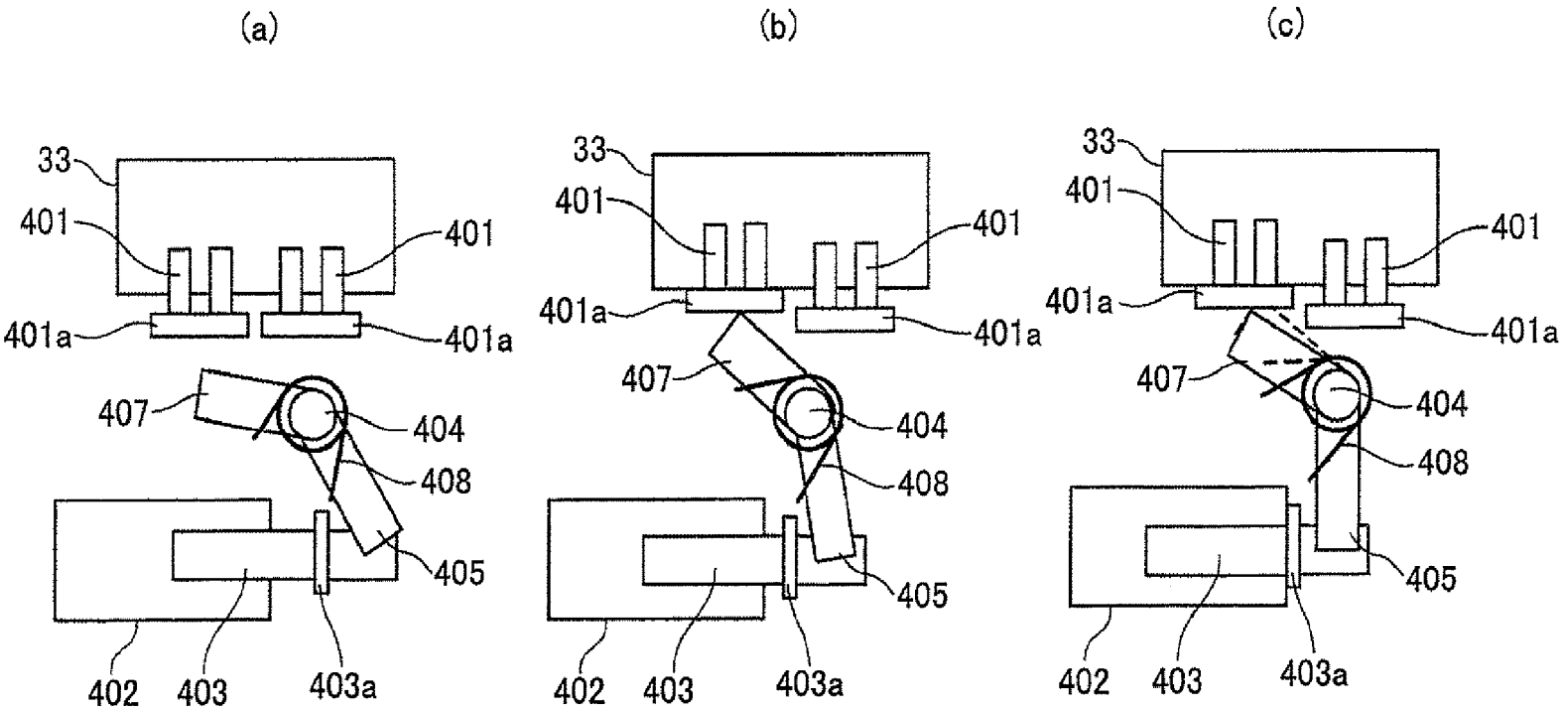
FIG. 25 is a schematic view for explaining operations of the air opening mechanism driving mechanism.

In the air opening driving mechanism 400 having the above-mentioned structure, when the air opening mechanism 204 is not opened, as shown in FIG. 25(*a*), the second lever 407 does not come in contact with the pressing member 401. In this state, by driving the solenoid 402 so that the plunger 403 is pulled in a direction indicated by an arrow A, the first lever 405 is oscillated in a direction indicated by an arrow B and the first lever 405 is oscillated. As a result of this, as shown in FIG. 25(*b*), the second lever 407 pushes the pressing member 401 due to the first lever 405 so that the engaging part 401*a* of the pressing member 401 comes in contact with the carriage 33.

At this time, as shown in FIG. 25(*c*), the amount of oscillation of the first lever 405 is fixed by the engaging part 403*a* of the plunger 403 of the solenoid 402 coming in contact with the solenoid 402. Here, in a case where an excessive load is generated when the pressing member 401 comes in contact with the carriage 33 so that a force indicated by an arrow C is applied to the second lever 407, the excessive load is offset by a biasing force of the spring member 408. A force at the time when the pressing member 401 comes in contact is held fixed.

Thus, the pressing member 401 can come in contact with the carriage 33 by dividing the lever member provided between the solenoid 402 and the pressing member 401 into the first lever 405 and the second lever 407 and providing the spring member between the first lever 405 and the second lever 407. As a result of this, a gap between the components can be made zero, a necessary pushing amount can be reduced, and the difference of opening capabilities of two air opening mechanisms 204A, 204B of a single sub-tank 35 can be made zero so that reliability of the air opening capabilities can be improved. Furthermore, operations loss of the solenoid can be reduced.

Figure 26:
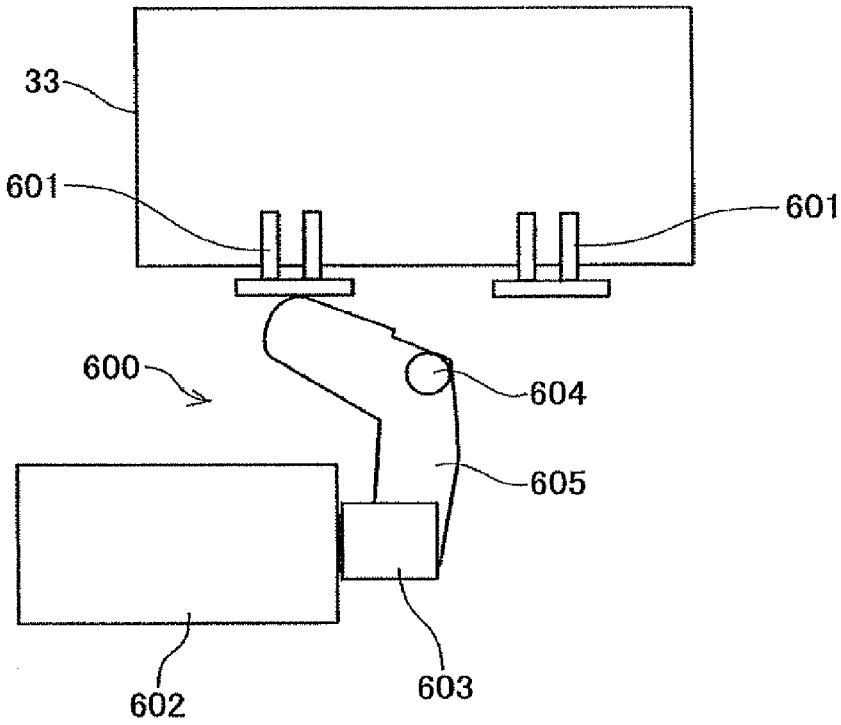
FIG. 26 is a schematic view for explaining an air opening mechanism driving mechanism of a comparative example.

FIG. 26 is a schematic view for explaining an air opening mechanism driving mechanism of a comparative example.

In an air opening driving mechanism 600 of the comparative example, an end part of a lever 605 is engaged with the plunger 603 of the solenoid 602. The lever 605 is oscillateably and pivotally supported at a spindle 604. The pressing member 601 is pressed by another end of the lever 605.

Figure 27:
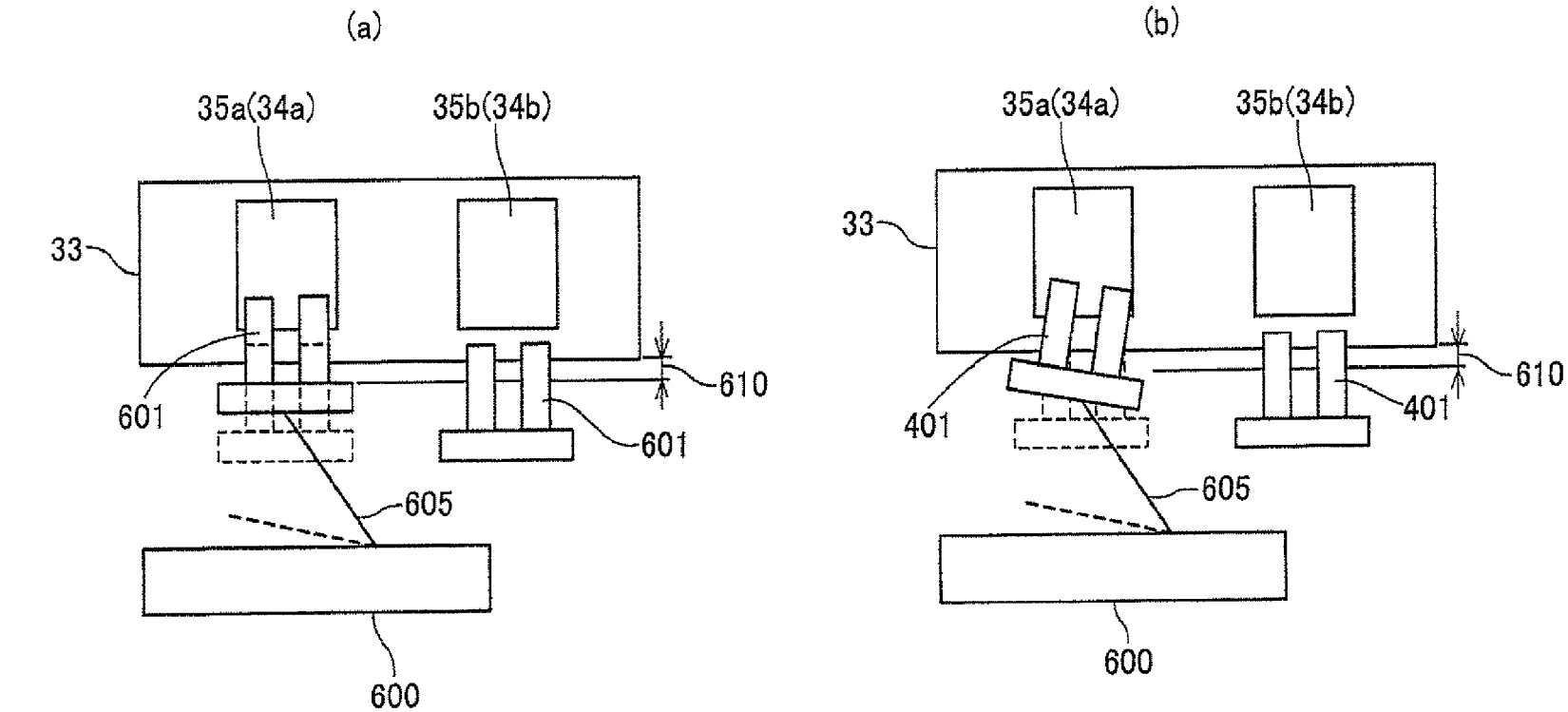
FIG. 27 is a schematic view for explaining operations of the air opening mechanism driving mechanism of the comparative example.

In a structure of the comparative example, as shown in FIG. 27, in order to prevent the excessive load from being applied to the lever 605, the carriage 33, and the head 34 (sub-tank 35) at the time of air opening, it is necessary to provide a gap 610. The gap 610 is formed by considering unevenness of components in the carriage 33 and the lever 605 when the pressing member 601 is in the pressing position (air opening position).

In other words, when the excessive load is applied to the lever 605, the lever 605 is deformed. In addition, when the excessive load is applied to the carriage 33 and the head 34 via the sub-tank 35, the jetting position of the ink is changed. In this case, if rigidity is increased in order to prevent deformation of the lever 605, the plunger 603 of the solenoid 602 stops with a gap so that the air opening operations force is reduced. In addition, since it is necessary to make a design where a sealing force of the air opening mechanism is decreased corresponding to the reduced operations force, sealability of the sub-tank 35 is decreased so that degradation of the ink is induced. Furthermore, if plural sub-tanks 35 are opened to the atmosphere as shown in FIG. 27(*b*), since the gap 610 is provided, the pressing member 601 may be inclined so that a portion where the air opening is available and a position where the air opening is not available may be generated left and right. As a result of this, it may be necessary to increase the gap including unevenness of the components and a pushing amount in a direction where the opening amount is small. This may cause the need for maximization of the apparatus.

On the other hand, in the air opening driving mechanism 400 discussed above, the excessive load is offset by the spring member. Therefore, when the pressing member 401 is in a pressing position, the gap with the carriage 33 is made zero so that it is possible to make the pressing member 401 come in contact with the carriage 33. As a result of this, the necessary pushing amount is reduced. In addition, the difference of opening capabilities of two air opening mechanisms of a single sub-tank 35 can be made zero so that the reliability of the air opening capabilities can be improved. Furthermore, operations loss of the solenoid can be reduced.

The image forming apparatuses of the embodiments of the present invention are not limited to have a printer single function but may have multiple functions such as a printer/facsimile/copier. Accordingly, the liquid container of the embodiment of the present invention may be applied such an image forming apparatus.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

This patent application is based upon and claims the benefit of priority of Japanese Patent Application No. 2008-225246 filed on Sep. 2, 2008, Japanese Patent Application No. 2009-47125 filed on Feb. 27, 2009, and Japanese Patent Application No. 2009-72823 filed on Mar. 24, 2009, the entire contents of which are incorporated herein by reference.

The invention claimed is:

1. An image forming apparatus comprising:

a liquid jet head;

a container main body configured to receive liquid to be supplied to the liquid jet head;

a liquid container including an air opening mechanism configured to open and close an air opening path in the container main body, the air opening path being configured to open an inside of the container main body to the atmosphere;

an air opening mechanism driving mechanism configured to move the air opening mechanism of the liquid container to open and close the air opening path; and a pressing member configured to press and move the air opening mechanism, wherein the air opening mechanism driving mechanism includes a solenoid provided on an apparatus main body, a first lever including one end part oscillateably engaged with the solenoid and another end part oscillateably and pivotally supported at a spindle, a second lever including one end part that can come in contact with the pressing member and another end part oscillateably and pivotally supported at the spindle, and a spring member disposed between the first lever and the second lever, to hold the first lever and the second lever to a designated positional relationship.

2. The image forming apparatus according to claim 1, wherein when an excessive load is generated when the pressing member comes in contact with the air opening mechanism and a force is applied to the first lever, the excessive load is offset by a biasing force of the spring member, and a force at a time when the pressing member comes in contact is held fixed.

3. The image forming apparatus according to claim 1, wherein a plurality of the pressing members are provided in a body corresponding to a plurality of the air opening mechanisms of a single one of the liquid container.

* * * * *

UNITED STATES PATENT AND TRADEMARK OFFICE

CERTIFICATE OF CORRECTION

PATENT NO. : 8,523,337 B2
APPLICATION NO. : 13/763830
DATED : September 3, 2013
INVENTOR(S) : Kiyoshi Tsukamura et al.

It is certified that error appears in the above-identified patent and that said Letters Patent is hereby corrected as shown below:

Replace the related U.S. application data on the title page of the patent, with the following:

--(63) Continuation of application No. 13/058,648 filed on Feb. 11, 2011 (now Pat. No. 8,398,218) which is a Section 371 of Application No. PCT/JP2009/064900 filed on Aug. 20, 2009 --

Signed and Sealed this
Fourth Day of February, 2014

Michelle K. Lee

Michelle K. Lee
*Deputy Director of the United States Patent and Trademark Office*